US009661884B2

(12) United States Patent
Yarahmadi

(10) Patent No.: US 9,661,884 B2
(45) Date of Patent: May 30, 2017

(54) FASHIONABLE VERSATILE MASK GARMENT RETAINS A FILTER ELEMENT IN A CONCEALED STATE

(71) Applicant: Shireen Noelle Yarahmadi, Alameda, CA (US)

(72) Inventor: Shireen Noelle Yarahmadi, Alameda, CA (US)

( * ) Notice: Subject to any disclaimer, the term of this patent is extended or adjusted under 35 U.S.C. 154(b) by 42 days.

(21) Appl. No.: 14/701,487

(22) Filed: Apr. 30, 2015

(65) Prior Publication Data

US 2016/0316831 A1 Nov. 3, 2016

(51) Int. Cl.

| | |
|---|---|
| ***A62B 18/08*** | (2006.01) |
| ***A41D 13/11*** | (2006.01) |
| ***A41D 23/00*** | (2006.01) |
| *A41D 27/08* | (2006.01) |
| *A62B 23/02* | (2006.01) |

(52) U.S. Cl.

CPC ..... *A41D 13/1153* (2013.01); *A41D 13/1161* (2013.01); *A41D 23/00* (2013.01); *A41D 27/08* (2013.01); *A62B 23/025* (2013.01)

(58) Field of Classification Search

CPC ..... A41D 13/1161
USPC ..... 128/206.19
See application file for complete search history.

(56) References Cited

U.S. PATENT DOCUMENTS

| | | | | |
|---|---|---|---|---|
| 3,678,929 | A | 7/1972 | Buscher | |
| 3,768,100 | A | 10/1973 | Colman et al. | |
| 3,878,563 | A | 4/1975 | Pulju | |
| 4,250,577 | A | 2/1981 | Smith | |
| 4,600,002 | A | 7/1986 | Maryyanek et al. | |
| 4,628,927 | A | 12/1986 | Ward | |
| 4,764,990 | A | 8/1988 | Markert | |
| 4,920,960 | A | 5/1990 | Hubbard et al. | |
| 5,020,533 | A | 6/1991 | Hubbard et al. | |
| 5,035,006 | A | 7/1991 | Hetz et al. | |
| 5,214,804 | A | 6/1993 | Carey et al. | |
| 5,322,061 | A | 6/1994 | Brunson | |
| 5,357,947 | A | 10/1994 | Adler | |
| 5,701,892 | A | 12/1997 | Bledstein | |
| 6,338,340 | B1 * | 1/2002 | Finch | A62B 23/025 128/205.27 |
| 6,609,516 | B2 | 8/2003 | Hollander et al. | |
| 6,718,982 | B2 | 4/2004 | Smith et al. | |

(Continued)

*Primary Examiner* — Kristen Matter

(57) ABSTRACT

A fashionable versatile mask garment made of a plurality of layered materials conceals a respiratory filter element releasably retained within, and as part of the garment, to protect a wearer's nose and mouth from airborne particulates. Two right and left upper straps and two right and left lower connectors extend outwardly from each of the opposing side edges, including multiple fastening mechanisms to secure mask garment at the wearer's lower-face, head, and neck. For versatility in purpose, the mask garment is adaptable from a first alternative position as a face mask, into a second alternative position as a head covering, or a third alternative position as a neck warmer, while continuing to contain the respiratory filter element in a concealed state so as to be accessible to a wearer at a moment's notice. Its function as a fashionable versatile mask garment with a concealable capability, is accomplished by using design methods, sewing techniques, embellishment and fabric applications common to casual and professional fashion attire.

12 Claims, 6 Drawing Sheets

(56) References Cited

U.S. PATENT DOCUMENTS

| | | | | |
|---|---|---|---|---|
| 6,928,657 | B2 * | 8/2005 | Bell | A41D 13/1161<br>128/206.12 |
| 7,107,628 | B2 | 9/2006 | Haaga | |
| 7,152,252 | B2 | 12/2006 | Gellis et al. | |
| 7,228,858 | B2 | 6/2007 | Baker | |
| 7,255,627 | B2 | 8/2007 | Bodnar et al. | |
| 8,549,662 | B2 | 10/2013 | Chang | |
| 8,621,668 | B1 | 1/2014 | Nolz | |
| 2016/0213959 | A1 * | 7/2016 | Barklow | A62B 23/025 |

* cited by examiner

FASHIONABLE VERSATILE MASK GARMENT RETAINS A FILTER ELEMENT IN A CONCEALED STATE

DETAILED DESCRIPTION OF PRESENT DISCLOSURE

In this detailed description, the following terms generally have the following meanings:

The term "fastening mechanism" refers to and defines an area of releasable attachment. The fastening mechanisms, and/or fastening connectors, and/or fasteners enable securing of the mask garment to reconfigure the lower-face and neck area into a closed configuration until the fastening mechanisms, and/or fastening connectors, and/or fasteners are separated. An fastening mechanisms, and/or fastening connectors, and/or fasteners may comprise one or more releasable coupling, fasteners, and/or fastening mechanisms, e.g., hooks, loops, bulbs, mushrooms, arrowheads, balls on stems, buttons, snaps, magnetic disks, cohesives, selective adhesives, etc. Fastening mechanisms, and/or fastening connectors, and/or fasteners comprise those elements of an fastening, coupling and/or mating system that form the area of releasable attachment via direct surface-to-surface contact forming an fastening mechanism, and/or fastening connector, and/or fastener closure. For the purpose of clarity, surface-to-surface contact encompasses contact between a surface of a hook material and a surface of a loop material, for example. The fastening mechanisms, and/or fastening connectors, and/or fasteners may be the hooks or the loops that are joined and connect with the other fastening mechanisms, and/or fastening connectors, and/or fasteners on a component comprised in mask garment, or on a portion of the mask garment.

The term "approximately" as used herein may be applied to modify any quantitative representation that could permissibly vary without resulting in a change in the basic function to which it is related.

As used herein, the term "visual signal" refers to a component that designates the visual signal comprising one or more structural, graphical, or textural element locations, in this instance, a placement pad location for a wearer to align a filter element adjacent a retainer means.

Reference will now be made in detail to the various components used to form the present disclosure and non-limiting embodiments, of which one or more examples are illustrated in the drawings FIGS. 1-10. Each example is provided by way of explanation of the disclosure and is not meant as a limitation of the disclosure. For example, features illustrated and described as part of one embodiment or position can be used on another embodiment or position to yield yet another embodiment. It is intended that the present disclosure include such modifications and variations.

Mask Garment

In one embodiment, referring now to FIG. 1, shows an inner perspective view of the present disclosure in an unfolded and generally flattened configuration. A mask garment 10 is in a generally trapezoidal shape wherein the dimensions from a right upper strap end 114 to a left upper strap end 116 are longer than the dimensions from a right lower connector end 118 to a left lower connector end 120. An imaginary centerline 136 passes through the center of mask garment 10, illustrating that the right side portion and left side portion of garment 10 are symmetrical to each another. Both right upper strap end 114 and right lower connector end 118 are unitarily formed and extend away from an opposing right side edge 119, and both left upper strap end 116 and left lower connector end 120 are unitarily formed and extend away an opposing left side edge 121 of mask garment 10. Additionally, a right tab extension 142*a* is unitarily comprised on right upper strap end 114, and a left tab extension 142*b* is unitarily comprised on left upper strap end 116. Right upper strap end 114 and left upper strap end 116 are designed to fit around the sides of a wearer's lower face and join at the back of the wearer's head, wherein right and left lower connector ends 118, 120 are designed to fit around the sides of the wearer's neck and join at the back of the wearer's neck.

Generally, as used herein, a right upper edge 122 and a left upper edge 124 will refer to that portion of mask garment 10 which is in proximity to and contacts the wearer's nose bridge, cheeks, below the temples, ears, and extends to the back of the wearer's head. As used herein, a right lower edge 126 and a left lower edge 128 will refer to that portion of mask garment 10 which is in proximity to and contacts the front and the back of the wearer's lower neck area.

In one embodiment, as illustrated in FIG. 1, a right tab extension 142*a* is unitarily formed on the right upper edge 122 of the right upper strap end 114, and a left tab extension 142*b* is unitarily formed on the left upper edge 124 of the left upper strap end 116 for fastening at the back of the wearer's head. Right and left tab extensions 142*a*, 142*b*, are from approximately 2 inches in width and approximately 2 inches in length and made of the same plurality of supple materials as mask garment 10. It should be appreciated that in other various non-limiting embodiments, right and left tab extensions 142*a*, 142*b*, can be unitarily or non-unitarily constructed and/or adjoined with one or more suitable fabric materials and/or different material compositions. It should be further appreciated that right and left tab extensions 142*a*, 142*b* can be of other suitable width and length dimensions.

In one embodiment, the entire mask garment 10 when unfolded and generally flattened may be in dimensions from approximately 33 inches to approximately 17 inches in width, from right upper and left upper strap ends 114, 116 and from approximately 15 inches to approximately 5 inches in height from right upper and left upper edges 122, 124 to right lower and left lower edges 126, 128. Those skilled in the art will recognize that mask garment 10 may be made in various sizes to fit children, teenagers, and adults of different head and neck dimensions.

In one embodiment, referring now to FIG. 2, mask garment 10 has an inner layer 12, desirably of a soft fabric, such as a flannel or fleece, for providing a soft, comforting, and non-irritating surface against the wearer's skin, and an outer layer 16, which is desirably a lightweight air permeable fabric to provide for passage of air without undue resistance to the wearer. To provide further durability, concealment, and to act as a non-engagement zone to VELCRO™, an inter-between layer 14, desirably a non-woven fabric and/or snag-resistant fabric material, such as polyester, is sandwiched throughout its entirety, between inner layer 12 and outer layer 16, as illustrated in a fragmentary sectional view in FIG. 4. It should be appreciated that in various non-limiting embodiments, inter-between layer 14 may be suitably constructed in certain particular areas of mask garment 10, and not necessarily throughout its entirety.

Regarding FIG. 2, inner layer 12, inter-between layer 14, and outer layer 16 are joined together at the peripheral edges, such as by sewing or adhesive bond, or otherwise incorporated wherein the reverse side of outer layer 16 is proximate to a portion of the obverse side of inter-between layer 14, and the reverse side of inner layer 12, is proximate to a portion of the reverse side of inter-between layer 14.

This plurality of layered construction forms a unitary base region 18 configured to be placed over the lower-face to enclose a nose and mouth of wearer. It should be appreciated that in various non-limiting embodiments, mask garment 10 may be constructed and fabricated with two or more layers of fabric materials. It should be further appreciated that mask garment 10 may be of different pieces of fabrics selectively attached and can be made in various colors and/or designed prints to aid in constructing the mask garment. Mask garment 10 may be constructed as a substantially unitary mask garment; alternatively, any portion of mask garment 10, may be further adjoined and/or may include one or more sections therein, made from one or more suitable fabric materials, including, but not limited to, cotton, jersey, silk, or any suitable combination thereof. Materials can be further insulating or non-insulating depending on climatic conditions and a wearer's particular use of the mask garment, and may include, without limitation, may be constituted of natural, man-made or manufactured material, or a composite thereof, may be plain or treated material, may be woven or non-woven cloth, and may be constituted of a hydrophobic material, a hydrophilic material, or a hygroscopic material or may be a functional combination of two or more layers of hydrophobic, hydrophilic, or hygroscopic materials. Mask garment 10 may be constituted of unilayer cloth or multilayer cloth, and may be generally soft and flexible.

Central Opening

In one embodiment, as illustrated in FIG. 2, one of two central openings are formed in mask garment 10 by the removal of an approximate 5"×2" rectangular shaped fabric material cut out from a portion of the center of unitary base region 18 from the base of inner layer 12 and the base of inter-between layer 14, at the approximate point where the wearer's nose and mouth reside. A first central opening 130*a* and a second central opening 130*b* are constructed in order to allow air space and provide breathability without substantial resistance when the wearer utilizes a releasable filter 133 at the first and second central openings 130*a*, 130*b*. The unitary base region 18 maintains filter 133 in correspondence with a wearer's nose and mouth. It is to be appreciated that the first and second central openings 130*a*, 130*b* may be formed by removal of fabric materials in other predetermined size and/or shape dimensions and/or configurations.

Mask garment 10 comprises a retainer frame 132 for retaining the releasable filter 133. The retainer frame 132 is desirably comprised of industrial strength hook strip fasteners, for example, VELCRO™ for receiving filter 133 positioned away from the wearer's face. Retainer frame 132 is adhered, such as by threaded stitch or adhesive bond, or otherwise incorporated, on the reverse side of inner layer 12 at first central opening 130*a* in the unitary base region 18, and collectively formed of hook strip fasteners in dimensions from ½" to 1" in width and in an approximate dimension of 6"×3" framing a portion of the remaining edges at the first central opening 130*a*. The retainer frame 132 abuts the reverse side of inter-between layer 14 and both inner layer 12 and inter between layer 14 are fully covered by outer layer 16, as is illustrated in FIG. 2.

Surprisingly, the retainer frame 132, comprised of hook strip fasteners, provides an excellent retaining means when filter 133 is desirably comprised of, or having attached thereto, by sewn stitch or adhesive bond, or otherwise, a fabric(s) and/or cloth material(s) with a comparable loop composition that mimics the loop side to which hook strip fasteners will (by design) automatically attach. For a more comfortable wear, retainer frame 132 sufficiently retains filter 133 over the nose and mouth of the wearer at unitary base region 18, thereby eliminating the use of ear loops and head ties typically associated with conventional face masks (not shown). It is to be appreciated that retainer frame 132 may be comprised in other suitable dimensions and shapes, other than rectangular. For instance, retainer frame 132 may be comprised of a larger or of a smaller dimension, of course, depending on the dimensions and shape of first central opening 130*a* formed in inner layer 12.

Releasable Respiratory Filter

Releasable respiratory filter 133 of the present disclosure may be of any fabric suitable for filtering out one or more types of airborne particles, gasses, or biological agents. The filter fabric may be of a woven or non-woven material. The filter fabric may be made of natural fibers, such as cotton or wool, or may be made from synthetic fibers such as polyester and polyurethane and/or synthetic foam materials. The filter fabric can be designed to filter airborne particles and/or gasses by mechanical mechanisms (e.g. by varying the weave density and/or fabric thickness or in the case of foam materials, the foam density) and/or by chemical mechanisms (e.g. by including absorptive charcoal particles embedded in the fabric and/or foam and/or by treating the fabric and/or foam with absorptive chemicals). Filters constructed as described above are capable of filtering out many common airborne pollutants/particulates such as smoke, dust and dirt. Generally, to remove bacteria and/or viruses from the air, a filter capable of filtering particles as small as 1 to 2 microns is required. Accordingly, the assembly of the layers of the filter fabric, or cloth forms a filter having a designated filtering function. The filtering function can be varied by changing the number of layers used and/or the pore size to one or more of the layers. Such filters are known in the art, certain types of flat pleated surgical masks being one such example (not shown), and are suitable for the present disclosure.

As illustrated in FIG. 2, filter 133 is mounted into retainer frame 132, wherein hook strip fasteners connect in an overlapping surface-to-surface contact at an approximate ¼ to ½ inch distance into all four sides of filter 133, thereby retaining filter 133 sufficiently in place, as illustrated in FIG. 8. For a more comfortable wear, the semi-rigid retainer frame 132 provides an extension of filter 133, into a spread, tent-like plenum position directed away from the contact points of the wearer's lower face.

Visual Signal Pad

In one embodiment, and now referring to FIGS. 1 and 5, a pad 300 is constructed as a visual signal point indicating a location for the wearer to place and align the releasable filter 133 for attachment into the retainer frame 132. Pad 300 comprises one or more structural, graphical, or textural elements. Pad 300 is desirably comprised of a non-woven fabric material, and of a color that is distinct, so as to provide contrast with any other colors of adjacent fabric materials within garment 10. Pad 300 is located on the reverse side of inner layer 12, and in direct correspondence with retainer frame 132, and is attached by sewing or adhesive bond, or otherwise incorporated, onto a portion of the reverse side of inner layer 12 and inter between layer 14. In various embodiments, pad 300 may comprise any suitable indicia for example, graphics, and/or may comprise different patterns, characters, pictorial symbols, drawings and logos, or carry other identifying indicia that provides contrast thereby increasing pad 300 visibility to the wearer.

Vapor Rolls

As illustrated in FIGS. 1 and 8, in one embodiment, for further securement of mask garment 10 so as to prevent air leakage at a nose bridge area 138, a right vapor roll 134*a* and a left vapor roll 1346 are attached by threaded stitch, adhesive bond, or other suitable means, and sandwiched between inner layer 12 and inter-between layer 14. Right vapor roll 134*a* is located at the right upper edge 122, and left vapor roll 134*b* is located at the left upper edge 124, and adjacent the nose bridge area 138. Vapor rolls 134*a*, 134*b*, are desirably constructed of nylon or any suitable wind resistant material, such as windbreaker material, or a soft-foam. Vapor rolls 134*a*, 134*b* may provide a reduced fogging of a wearer's eyeglasses by preventing warm vapor laden air from passing upwards and through the center of right upper and left upper edges 122, 124 of mask garment 10. With the vapor roll feature, and along with the snug fit of the mask, warm moist air is forced in a downward fashion so as to escape from filter 133.

First and Second Fastening Points at the Back of a Wearer's Head

As is illustrated in FIGS. 1 and 7, mask garment 10 encompasses at least one of three fastening points comprised of multiple fastening mechanisms. A first fastening point 101 and a second fastening point 102 are comprised with fastening means at the back of the wearer's head, and a third fastening point 103 is comprised with fastening means at the back of the wearer's neck.

As illustrated in FIG. 1, in order to secure garment 10 at the back of the wearer's head, the first fastening point 101 is located at the right upper strap end 114 and comprises a first fastening mechanism 140*a*, attached by sewing or bond adhesive, or otherwise incorporated and contained inside of right tab extension 142*a*. A second fastening mechanism 140*b* is attached by sewing or bond adhesive, or otherwise incorporated onto a portion of right upper strap end 114, wherein second fastening mechanism 140*b* is located below and adjacent first fastening mechanism 140*a*.

In order to further secure garment 10 at the back of the wearer's head, the second fastening point 102 is located at the left upper strap end 116 and comprises a third fastening mechanism 140*c*, attached by sewing or bond adhesive, or otherwise incorporated and contained inside of left tab extension 142*b*. A fourth fastening mechanism 140*d* is attached by sewing or bond adhesive, or otherwise incorporated onto a portion of left upper strap end 116, wherein fourth fastening mechanism 140*d* is located below and adjacent third fastening mechanism 140*c*.

First, second, third, and fourth fastening mechanisms 140*a*, 140*b*, 140*c*, and 140*d* are desirably comprised of commercially available magnetic disk components, wherein first and second fastening mechanisms 140*a*, 140*b*, and third and fourth fastening mechanisms 140*c*, 140*d* are oriented with a common pole, either the north or the south, in order to be lapped, engaged and fastened. It should be appreciated that mask garment 10, in other various non-limiting embodiments, may comprise different fastening mechanisms, or a fastening mechanism device and/or a different fastening mechanism composition other than magnetic disk components, for example, fastening mechanisms such as mechanical fasteners, e.g. hook and loop fasteners, macrofasteners, buttons and button holes, snaps, tab and slot fasteners, hermaphroditic fasteners, hinged clips, and/or any other suitable fastening mechanisms.

In one embodiment, as illustrated in FIG. 7, right tab extension 142*a* is illustrated in a closed and fastened position at the back of the wearer's head, wherein a portion of the left upper strap end 116 at the left upper edge 124 is clamped and secured between first fastening mechanism 140*a*, and second fastening mechanism 1406. FIG. 7 further illustrates left tab extension 142*b* in a closed and fastened position at the back of the wearer's head, wherein a portion of the right upper strap end 114 at the right upper edge 122 is clamped between third fastening mechanism 140*c* and fourth fastening mechanism 140*d*. The magnetic interaction between fastening mechanisms 140*a*, 140*b* at first fastening point 101 and fastening mechanisms 140*c*, 140*d* at the second fastening point 102, hold mask garment 10 in a releasable closed position at the wearer's lower face and at the back of the wearer's head. Fastening mechanisms 140*a*, 1406 and 140*c*, 140*d* allow a certain degree of adjustability for sizing and snugness of mask garment 10 around the lower face and head when the wearer simultaneously slides right tab extension 142*a* and left tab extension 1426 in opposite directions away from each other, along upper edges 122, 124 of right and left upper strap ends 114, 116.

First, second, third, and fourth fastening mechanisms 140*a*, 140*b*, 140*c*, and 140*d* are encapsulated in semi-soft polyvinyl chloride and/or silicone and thereby provides pliable tab extensions 142*a*, 142*b*, and further cause the fastening mechanisms 140*a*, 140*b*, 140*c*, and 140*d* to be unaffected by contact with water, so as to not be degraded with multiple washings. Typically, fastening mechanisms 140*a*, 140*b*, 140*c*, and 140*d* may be from approximately 1½"×1½" and a thickness of less than one eighth of an inch, and approximately a sixteenth of an inch, although as can be appreciated, in other various non-limiting embodiments, magnetic disk fastening mechanisms can be of a thickness of more than one eighth of an inch, and more than a sixteenth of an inch and may be in any other suitable strengths, shapes, and size dimensions.

Third Fastening Point at the Back of a Wearer's Neck

Mask garment 10 further comprises the third fastening point 103 in order to secure mask garment 10 at the back of the wearer's neck. As is illustrated in FIGS. 1 and 7, to further secure mask garment 10, a fifth fastening mechanism 144*a* is attached by threaded stitch or adhesive bond, or otherwise incorporated onto a portion of right lower connector end 118 extending from right side edge 119, and a sixth fastening mechanism 144*b*, is attached by threaded stitch or adhesive bond, or otherwise incorporated, onto a portion of left lower connector end 120 extending from left side edge 121. Right and left lower connector ends 118, 120 are further designed to secure and join mask garment 10 at the back of the wearer's neck. Fifth and sixth fastening mechanisms 144*a*, 144*b*, are desirably a series of snap adjusters, but alternate fastening mechanisms can be attached with a series of other suitable fastening mechanisms, for example, fifth and sixth fastening mechanisms 144*a*, 144*b* may comprise mechanical fasteners, e.g. hook and loop, macrofasteners, magnetic disk fasteners, buttons and button holes, tab and slot fasteners, hermaphroditic fasteners, hinged clips, or any other suitable fastening mechanisms may be used to secure mask garment 10 at the back of the wearer's neck. Fifth and sixth fastening mechanisms 144*a*, 1446 allow a certain degree of adjustability for sizing and snugness of mask garment 10 around the wearer's lower chin and neck region.

Non-Engageable Material for Hook Strip Fasteners

Along with providing durability for mask garment 10, inter-between layer 14, further serves a second function as a non-engageable fabric material to the hook strip fasteners of retainer frame 132, when inter-between layer 14 is desirably comprised of a non-woven fabric material. Many fabric and/or cloth material constructions are prone to attaching to the hook side of hook and loop fasteners. Hook fasteners can snag, pull, and damage typical fabric materials, and the like, if the material construction mimics the loop side of hook and loop fasteners, to which the hook side will (by design) automatically attach. Inter-between layer 14 serves to overlap and cover the reverse side of inner layer 12, comprising retainer frame 132, in order to protect the fabric materials of outer layer 16, and/or any other fabric and/or cloth materials of mask garment 10, and/or any other fabric and/or cloth materials that may come into contact and may be susceptible to damage from the hook strip fasteners of retainer frame 132.

Concealment Material for Filter

Along with providing durability, and preventing retainer frame 132 from attaching, snagging and damaging other fabric materials in or around mask garment 10, inter-between layer 14 serves yet a third function and provides for concealment of filter 133. Inter-between layer 14 is desirably the same congruent color as filter 133 so that when filter 133 is mounted at retainer frame 132 and seated at second central opening 130*b*, the inter-between layer 14 will blend in with the congruent color of filter 133 so as to make filter 133 indistinguishable and appear as one and the same of a constructed fabric material as inter-between layer 14.

As illustrated in FIG. 2, outer layer 16 serves to cover and overlap both inter-between layer 14 and inner layer 12, for concealment of first and second central openings 130*a*, 130*b*, retainer frame 132, filter 133, placement pad 300 and any other various attachments and/or components comprised inside mask garment 10. As illustrated in FIG. 3, an in-depth fragmentary sectional view illustrates the location of the plurality of layers 12, 14, and 16, retainer frame 132, filter 133, and placement pad 300 within unitary base region 18 of mask garment 10.

Stitched Tapering Folds

As illustrated in FIGS. 1, 2, and 6, prior to assembly, and in order to achieve a more advantageously shaped contoured fit at the sides of wearer's lower-face, cheeks, and at a chin-neck region 112, sewing techniques can be applied. In this instance, for a lean, snug and contoured fit at the sides of the wearer's lower face and cheeks, a right stitched tapering fold forms a right tapered cheek pocket region 104 and a left stitched tapering fold forms a left tapered cheek pocket region 106, approximately one inch wide and four inches in length are gathered and sewn into layers, 12, 14, and 16.

Two additional stitched tapering folds, a right and a left stitched tapering fold 108, 110, are gathered and taken in for a lean, snug and contoured fit at the chin-neck region 112, approximately one inch wide and three inches in length and gathered and sewn into layers 12, 14, and 16, adjacent the bottom edge of retainer frame 132, as illustrated in FIGS. 1 and 2. A snug, tapered, and contoured fit about the wearer's lower-face, cheeks, and chin-neck region 112 is not only fashionably appealing, but also prevents potential air leakage of inhaled or exhaled air around the upper edges 122, 124 and lower edges 126, 128 of mask garment 10, as illustrated in FIG. 6.

Design Method and Embellishment

In one embodiment, and as those skilled in the art of garment manufacturing will understand, the obverse side of outer layer 16 is desirably comprised with a design method of a shirred and/or crimped application to the fabric material. It is to be appreciated, that mask garment 10 in other various non-limiting embodiments, may comprise a non-shirred and/or a non-crimped fabric application in way of design. It is further desired that outer layer 16 can be adorned with various decorative embellishments 30 that may include beads, designed prints, leather fringe, pearls, crystals, and the like, to enhance the aesthetic appeal and to satisfy different aesthetic desires, as illustrated in FIGS. 6 and 9, although in other non-limiting embodiments, embellishment 30 may not be applied.

Releasable Filter Placement

Now described is the progression of how filter 133 is retained onto retainer frame 132 by way of pad 300. The wearer visually locates pad 300, by indicia, or one or more structural, graphical, or textural elements comprised thereon, and places and aligns filter 133 onto pad 300 so that filter 133 is now sandwiched between pad 300 and the retainer frame 132 comprised on the reverse side of inner layer 12. Once filter 133 is correctly placed and aligned, wearer then applies direct pressure onto the obverse side of inner layer 12, at the remaining edges of first central opening 130*a*, in order for retainer frame 132 to connect in an overlapping surface-to-surface contact at an approximate ¼ inch to ½ inch distance into all four sides of filter 133, and thereby holding and retaining filter 133 sufficiently in place.

Further described is the progression of how mask garment 10 is donned in the first position as a face mask and secured at the back of a wearer's head.

For an easier donning of mask garment 10 in a first position as a face mask, it is desirable that the wearer first secures mask garment 10 at the third fastening point 103 and seats the mask garment 10 at the wearer's lower neck area, before beginning the adjustment of first and second fastening mechanisms 140*a*, 140*b* and third and fourth fastening mechanisms 140*c*, 140*d* at the back of wearer's head.

Further described is the progression of how mask garment 10 is donned and secured at the back of a wearer's neck.

To secure mask garment 10 at the back of the wearer's neck area, the wearer places the soft obverse side of inner layer 12 with unitary base region 18 in direct correspondence with the center and front of wearer's neck area. At third fastening point 103, of the at least three fastening points, wearer extends right lower connector end 118, comprising fifth fastening mechanism 144*a*, rearward to the back of the right side of wearer's neck and then extends the left lower connector end 120, comprising sixth fastening mechanism 144*b*, rearward to the back of the left side of wearer's neck and then fastens garment 10 at the back of wearer's neck, as illustrated in FIG. 7. Fifth and sixth fastening mechanisms 144*a*, 1446 can be adjusted and connected in a manner that provides a snug, yet comfortable fit, in order to prevent gapping and/or air leakage in or out of mask garment 10.

To further secure mask garment 10 at the wearer's lower face and at the back of the wearer's head, the wearer draws unitary base region 18 containing filter 133, in an upward position and towards wearer's nose and mouth and horizontally places the nose bridge area 138 at the center of wearer's nose bridge. Wearer holds right tab extension 142*a* and extends the right upper strap end 114 rearward to the back of the right side of wearer's head and holds left tab extension 142*b* and extends the left upper strap end 116 rearward to the back of the left side of wearer's head. Wearer then proceeds to bring right tab extension 142*a* over and across left tab extension 142*b*, wherein right tab extension 142*a* is now located on the opposite side of left tab extension 142*b* at the back of the wearer's head, and right upper strap end 114 now overlaps left upper strap end 116.

The wearer folds right tab extension 142*a*, containing first fastening mechanism 140*a*, in a downward direction towards the wearer's head and over a portion of left upper edge 124 in order to hold and connect with second fastening mechanism 140*b* located on right upper strap end 114. First and second fastening mechanisms 140*a*, 140*b* connect by holding left upper strap end 116 in a clamped position with right upper strap end 114 at the back of the wearer's head. Wearer then folds left tab extension 142*b*, containing third fastening mechanism 140*c*, in a downward direction away from the wearer's head and over a portion of right upper edge 122 in order to hold and connect with fourth fastening mechanism 140*d* located on left upper strap end 116. Third and fourth fastening mechanisms 140*c*, 140*d* connect and hold right upper strap end 114 in a clamped position with left upper strap end 116 at the back of wearer's head. FIG. 7 illustrates a rearward view of mask garment 10 in a secured and donned first position as a face mask utilizing adjustable fastening mechanisms 140*a*, 140*b*, and 140*c*, 140*d* at the back of the wearer's head.

First and second fastening mechanisms 140*a*, 1406 and third and fourth fastening mechanisms 140*c*, 140*d* allow a certain degree of incremental adjustability for sizing, comfort, and snugness around the wearer's lower face and head. For a snug fit, the wearer simultaneously slides right tab extension 142*a* and left tab extension 142*b* horizontally, and in opposite directions away from each other, along upper edges 122, 124 of right and left upper strap ends 114, 116. Furthermore, fastening mechanisms 140*a*, 140*b* and 140*c*, 140*d* provide for a quick releasable attachment of upper right strap end 114 and upper left strap end 116 around the wearer's lower-face and head.

Right tab extension 142*a* and left tab extension 142*b* remain folded, attached, and secured at a portion of right and left upper edges 122, 124 until first and second fastening mechanisms 140*a*, 140*b* and third and fourth fastening mechanisms 140*c*, 140*d* are released.

Alternative Positions

The wearer may desire to adapt mask garment 10 into at least one of three fashionable alternative positions, wherein mask garment 10 continues to contain filter 133 in a concealed state and to be accessible at a moment's notice. Wearer may desire to adapt garment 10 from the first alternative position as a face mask into a second alternative position as a head covering, as illustrated in FIG. 9, or into a third alternative position as a neck warmer, as illustrated in FIG. 10.

For further warmth and insulation, or when filter 133 is not warranted or is not being utilized, the wearer may choose to cover the first central opening 130*a*, when mask garment 10 is adapted into one of at least three alternative fashionable positions.

In one embodiment, as illustrated in FIG. 1, a central opening cover 148, desirably constructed of the same fabric material as inner layer 12, is connected to mask garment 10, on the reverse side of inner layer 12 in a portion of the chin-neck region 112 by way of a tethered elastomeric material (not shown), so that there is less likelihood of losing cover 148 and a certainty, that when needed, cover 148 will be available. For a secure hold at first central opening 130*a*, cover 148 can be tucked into and under at all four sides of retainer frame 132 and sandwiched between retainer frame 132 and filter 133. While the wearer utilizes cover 148, filter 133 continues to remain attached and retained at retainer frame 132. When wearer desires to utilize filter 133, or no longer desires cover 148 over first central opening 130*a*, the cover 148 is easily detachable and can be rolled up and further stowed within chin-neck region 112, as illustrated in FIG. 8.

Referring now to FIG. 9, alternatively, mask garment 10 may be further adapted into a second alternative position as a head cover in accordance with one non-limiting embodiment, for warmth and for the security of having protective filter 133 accessible when the need may be warranted. In order to configure mask garment 10 into a head covering, wearer holds right upper strap end 114 in one hand, and left upper strap end 116 in the other with right and left tab extensions 142*a*, 142*b* in an opened position.

With first and second fastening mechanisms 140*a*, 1406 on the right and third and fourth fastening mechanisms 140*c*, 140*d* on the left, tab extensions 142*a*, 142*b* are placed under the wearer's chin area where first fastening mechanism 140*a* onto fourth fastening mechanism 140*d* and third fastening mechanism 140*c* onto second fastening mechanism 140*b* and fastened. Right and left connector ends 118, 120 are then adjoined at the back of the head near the lower neck of a wearer, with fifth and sixth fastening mechanisms 144*a*, 144*b* fastened for further securement.

Referring now to FIG. 10, alternatively, mask garment 10 may be further adapted into a third alternative position as a neck warmer in accordance with one non-limiting embodiment, for warmth and for the security of having protective filter 133 accessible when the need may be warranted.

In order to configure mask garment 10 into the third alternative position as a neck warmer, the wearer secures mask garment 10 at the third fastening point 103 and seats mask garment 10 at the wearer's lower neck area before beginning the adjustment of first and second fastening mechanisms 140*a*, 140*b* and third and fourth fastening mechanism 140*c*, 140*d* at the back of wearer's upper neck area.

Right tab extension 142*a* and left tab extension 142*b* remain folded, secured, and connected at a portion of right and left upper edges 122, 124 until first and second fastening mechanisms 140*a* and 140*b* and third and fourth fastening mechanisms 140*c* and 140*d* are released.

One of the many possible examples of when a wearer may desire to utilize the present disclosure in the first alternative position as a face mask, is when the wearer is on his or her way to work and using a form of mass transit and faced with being enclosed inside of a train car in tight quarters with individuals who may be showing signs of illness, for example, coughing and/or sneezing. In such a situation, the wearer may very well choose to protect themselves from such airborne particulates. In this instance, the wearer can quickly deploy mask garment 10 into the first position as a face mask and access the concealed and readily available filter 133 in an inconspicuous manner. Mask garment 10 should remain in position while the wearer continues his or her ordinary commuting activities. In the alternative, mask garment 10 may be deployed as a face mask when wearer may be experiencing signs of illness. The wearer can utilize mask garment 10 so as to have a soft, warm, and comforting face mask garment to place against the wearer's lower-face and neck and use the readily available concealed filter 133 to protect others from such airborne particulates.

Further, it should be appreciated that the benefits of the present disclosure are not limited to any particular style or configuration.

The various non-limiting embodiments of the present disclosure described above are for purposes of illustration only and the various modifications and changes of these embodiments can be made without departing from the spirit and scope of the disclosure and without diminishing its intended advantages. It is therefore intended that such modifications and changes be covered by the appended claims hereto.

BACKGROUND

There are many dangerous situations today where it is necessary to filter the air that is inhaled and exhaled by human beings. In recent times, there has been concern for public safety with respect to detrimental effects of prolonged exposure of the general public to pollution in the form of airborne particulates, with the most common forms typically encountered consisting of automotive exhaust, industrial pollutions, smoke whether caused by uncontrolled fires or from nearby manufacturing plants, dust, dirt, pollens and infectious biological agents and infectious diseases.

Though rarely encountered, there has been concern for public safety with respect to biological attacks on the public with the potential for biological attacks believed to be primarily in the form of airborne chemicals or biological agents. Concern has also risen among the general public regarding protection from airborne infectious diseases such as SARS or a potential flu pandemic.

Areas for the conveyance and contact of potentially harmful airborne particulates include, but are not limited to public gatherings such as shopping malls, sporting events, educational institutions, hospitals/medical facilities, workplaces, urban environments, and mass public transportation. When in a public setting, many people have no warning or the ability to reduce potential exposure to potentially harmful airborne particulates, and consequently may have no choice but to stay within a contained and/or confined, and/or closed area until one has the ability to depart from a particular area. During this time, potential unhealthy airborne particulates can be released (e.g. poisons, automotive exhausts, dust, fluids, soot, and smoke) and/or unhealthy, infectious aerosols can be transmitted from one person to another. In other instances, many people can be susceptible to illness from irritants such as nauseous odors in the air, and/or airborne allergens (e.g. dust and pollens) can further increase problems for people with allergies and/or those who have respiratory symptoms of asthma and/or low immune systems.

Much effort has been expended toward the development and designing of safety apparel to provide protection from unhealthy airborne particulates. For instance, in many hospitals and doctor's offices, medical personnel wear protective facemasks that come in various configurations and are standard procedure in the medical and healthcare fields. Medical and surgical facemasks are primarily used by medical staff to protect themselves and others from bacteria/virus transmission by way of airborne aerosols. Infectious diseases and/or a bacterial virus are most commonly transmitted by close and/or actual contact from one person to another. But medical and surgical facemasks are not commonly used outside of the medical setting.

In addition to the above, other more complex mask systems have been developed. One such example is U.S. Pat. No. 6,338,340 entitled FILTER MASK issued to Finch and Ellison on Jan. 15, 2002. The Finch and Ellison filter mask includes a disposable filter element sized to cover the nose and mouth of a user and to be worn in conditions of fire and smoke inhalation.

While the Finch and Ellison filter mask device may be effective in reducing the likelihood of smoke inhalation and airborne particulates, this device and like the simpler facemasks mentioned above, have drawbacks. Namely, such masks are not commonly carried and are not commonly worn by the general public. Furthermore, such masks are obtrusive and not constructed to be worn in an inconspicuous and/or concealed manner.

Furthermore, facemasks are not readily and/or easily accessible to the general public unless one is at a hospital or medical facility where facemasks are commonly provided. It is often inconvenient for people to carry a facemask along with them when out in a public area, and/or not something most people remember to do or practice doing unless they are in the habit of doing so or have a type of medical condition that requires them to do so.

Even when a facemask may be warranted or should at least be used for precautionary measures, the public is generally reluctant to wear a facemask due to the possible social stigma and the obtrusiveness of a facemask, being aesthetically displeasing. In a public setting, the wearing of a facemask can be intimidating for the wearer and can be particularly frightening to those around the wearer who may view the facemask as threatening. Room for improvement remains in the art.

Another drawback to facemask is they can be uncomfortable. A primary complaint of wearers of facemasks is that after an extended period of time the facemask can cause abrasion at the contact points between the facemask and the wearer's skin, and more particularly, along the periphery of the facemask. Such abrasion leads to chaffing and redness accompanied by discomfort. Further, many securing devices on facemasks are ear loops or tie fasteners, but the ear loops can be uncomfortable and tie fasteners are known to be difficult to fasten at the back of the head and can be a major problem when an emergency situation occurs and time is of the essence.

As a result of the above drawbacks, it would be desirable to improve the general public's wearing of a filter element in a public setting when the need may be warranted, for instance, in the case of soot and/or smoke or biological attack, or for precautionary measures for example, to protect oneself from vehicle exhaust or cigarette smoke.

Objects and Advantages

The present disclosure overcomes the deficiencies of the prior art by providing a fashionable mask garment that is comfortable, readily accessible, and by way of design and fabric application, has the capacity to conceal the wearing of a filter element in a public setting.

It is therefore an advantage of the present disclosure to provide a mask garment that by way of design and fabric applications, conceals the wearing of a filter element in a public setting whereby eliminating an obtrusive and/or threatening appearance, and in this way providing an improved chance a wearer will use a protective filter element when the need may be warranted.

It is therefore still another advantage of the present disclosure to provide a mask garment that is comfortable and eliminates the wearing of conventional filter element securing devices such as ear loops or manual tie straps (not shown).

It is therefore yet another advantage of the present disclosure to provide a mask garment that contains a retaining means that extends a filter element away from the contact points of a wearer's face, and can be worn comfortably for an extended period of time.

It is therefore an object and advantage of the present disclosure to provide a mask garment that has potential for embellishment, provides a lean appearance and is fashionably appealing. Moreover, it is contemplated that ornamental embellishments may be sewn in or attached by suitable means which may serve to enhance a wearer's desire to wear the present disclosure and to use a protective filter element in a public setting when the need may be warranted.

Still yet another object and advantage of the present disclosure is to provide a mask garment that is versatile and adaptable into other fashionable versatile alternative positions. The ability of a mask to be versatile and adaptable provides an improved chance the wearer will remember to, and/or by habit, and/or automatically wear, and/or carry and/or otherwise have the lower-face mask readily accessible on a relatively consistent basis when out in a public setting where a protective filter element may be warranted.

Yet still, another object and advantage of the present disclosure is to provide a mask garment that is durable, washable, and dryable.

BRIEF DESCRIPTION OF THE DRAWINGS

The above-mentioned and other objects and advantages of the present disclosure, and the manner of attaining them, will become more apparent and the disclosure itself will be better understood by reference to the following description of non-limiting embodiments of the disclosure taken in conjunction with the accompanying drawings.

It should be understood that the drawings are not necessarily to scale; instead, emphasis has been placed upon illustrating the principles of the disclosure. In addition, in the embodiments depicted herein, like reference numerals in the various drawings refer to identical or near identical structural elements.

Figure 1:
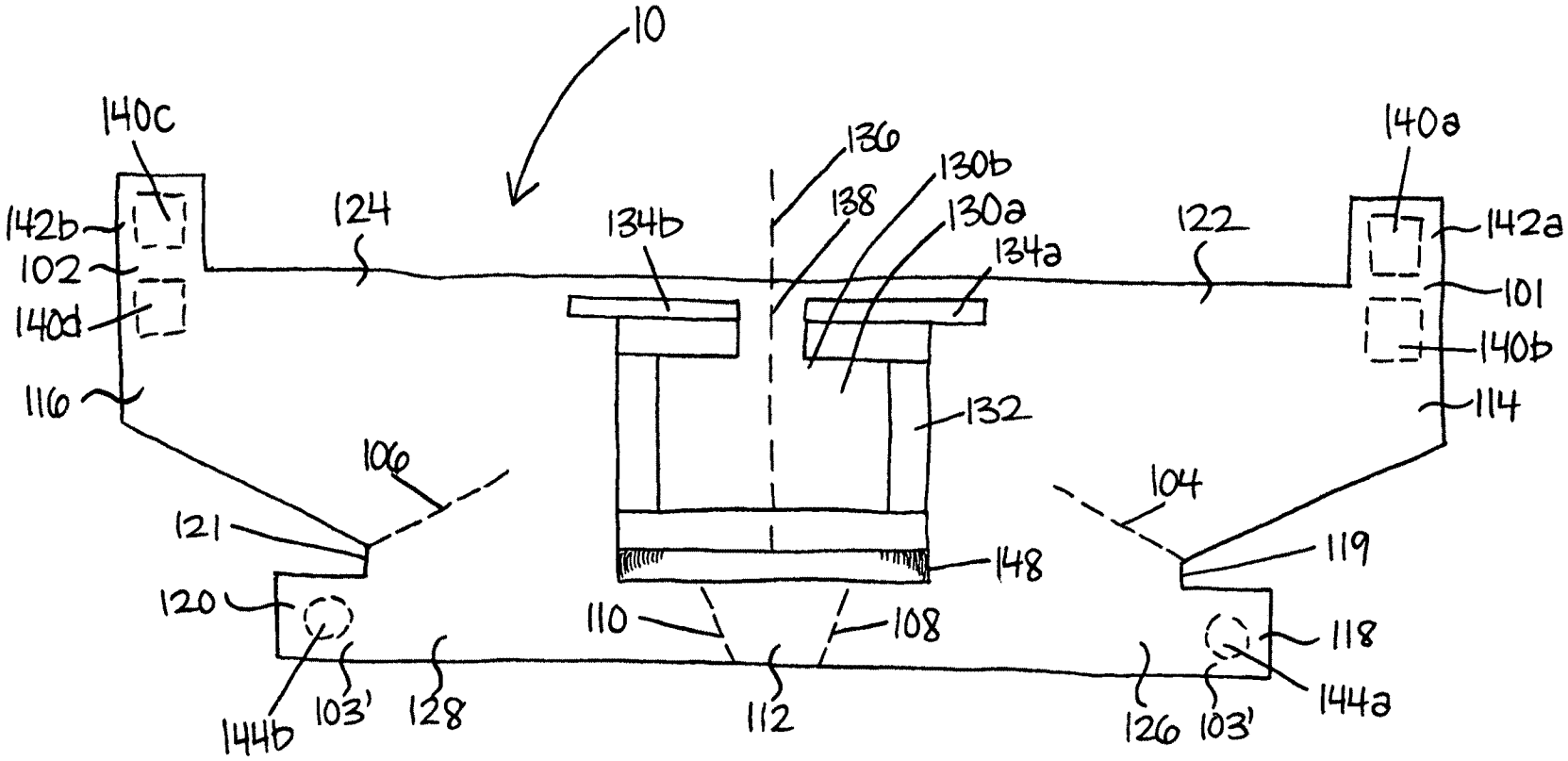
FIG. 1: illustrates an inner perspective view of the present disclosure, prior to being formed, in an unfolded, generally flattened configuration in accordance with one non-limiting embodiment.
Figure 2:
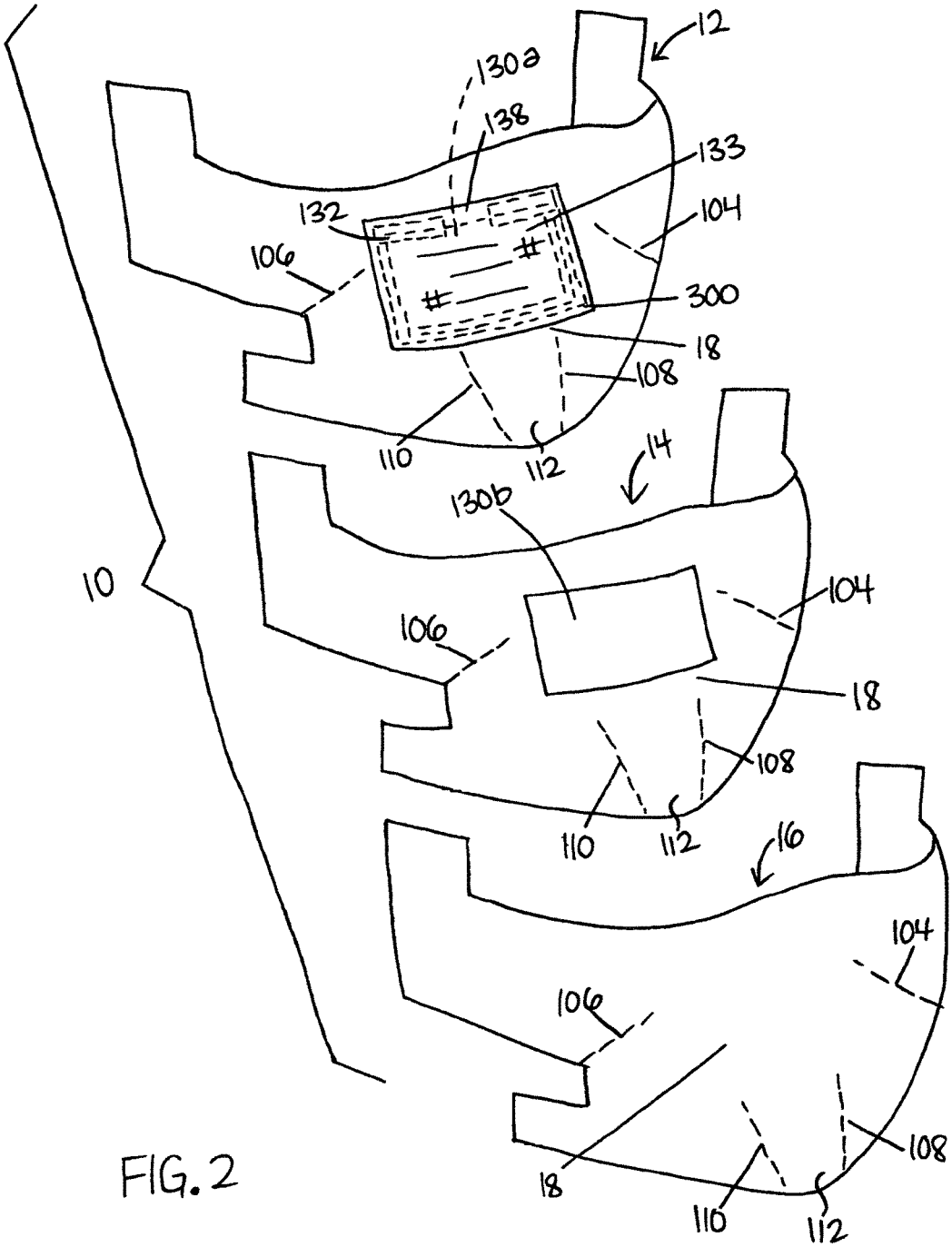
FIG. 2: illustrates an exploded perspective view of the present disclosure in accordance with one non-limiting embodiment.
Figure 3:
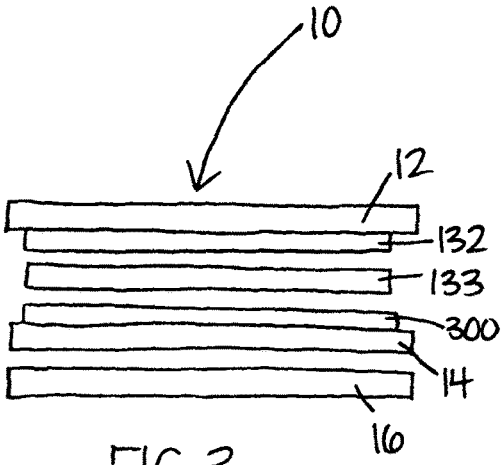
FIG. 3: illustrates an in-depth fragmentary sectional view of the present disclosure in accordance with one non-limiting embodiment.
Figure 4:
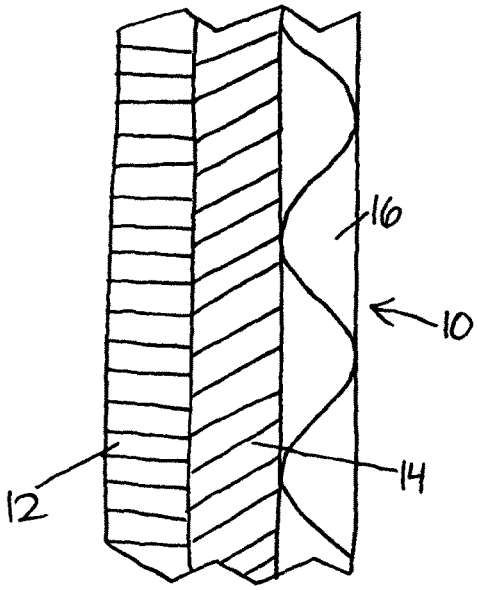
FIG. 4: illustrates a fragmentary sectional view of present disclosure in accordance with one non-limiting embodiment.
Figure 5:
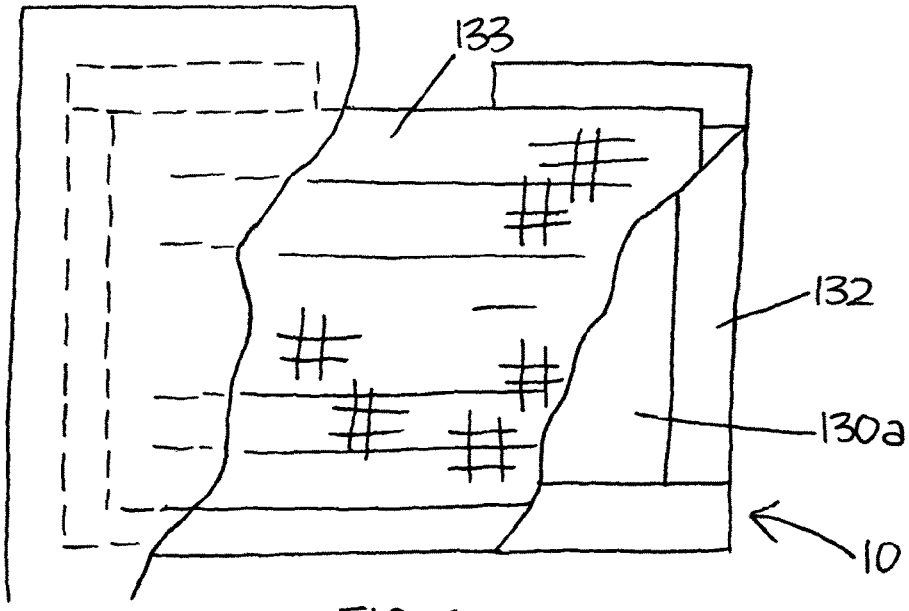
FIG. 5: illustrates a sectional view of present disclosure with a visual signal for a placement pad into which a filter element is received in accordance with one non-limiting embodiment.
Figure 6:
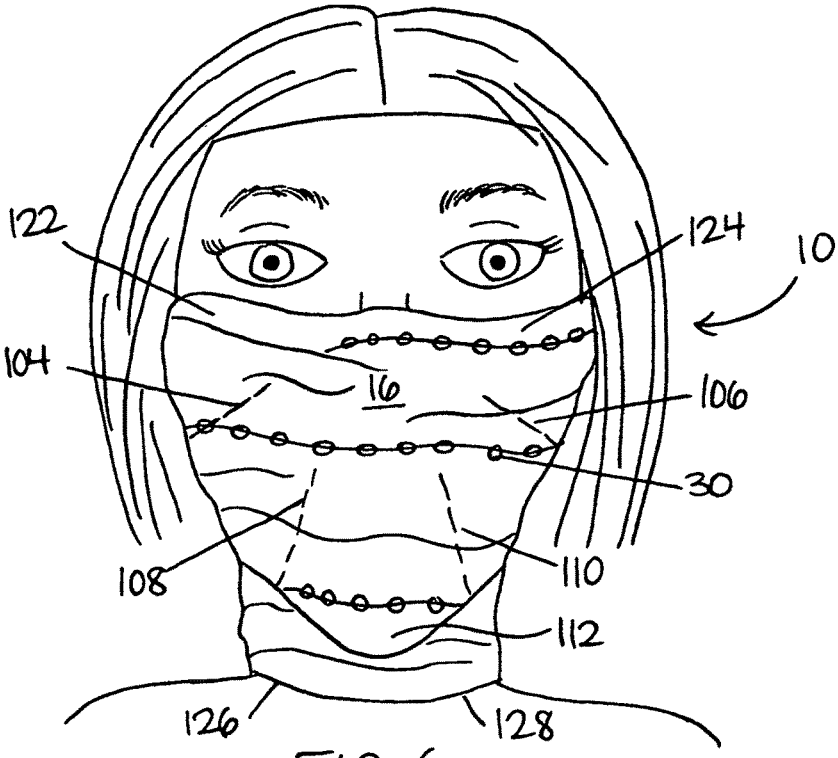
FIG. 6: illustrates a frontally facing perspective view of present disclosure in a first position as a face mask on a wearer in accordance with one non-limiting embodiment.
Figure 7:
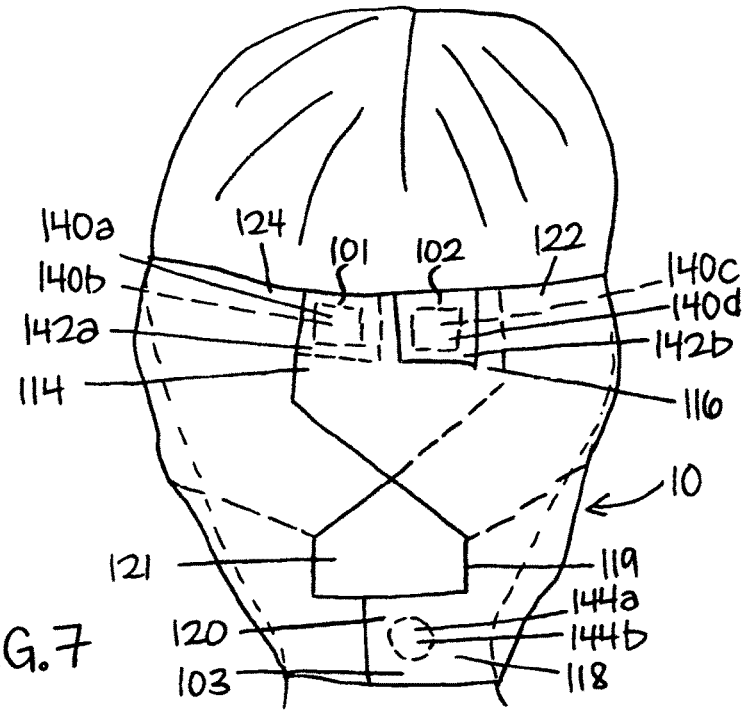
FIG. 7: illustrates a rearwardly facing perspective view of present disclosure in a first position as a face mask on a wearer in accordance with one non-limiting embodiment.
Figure 8:
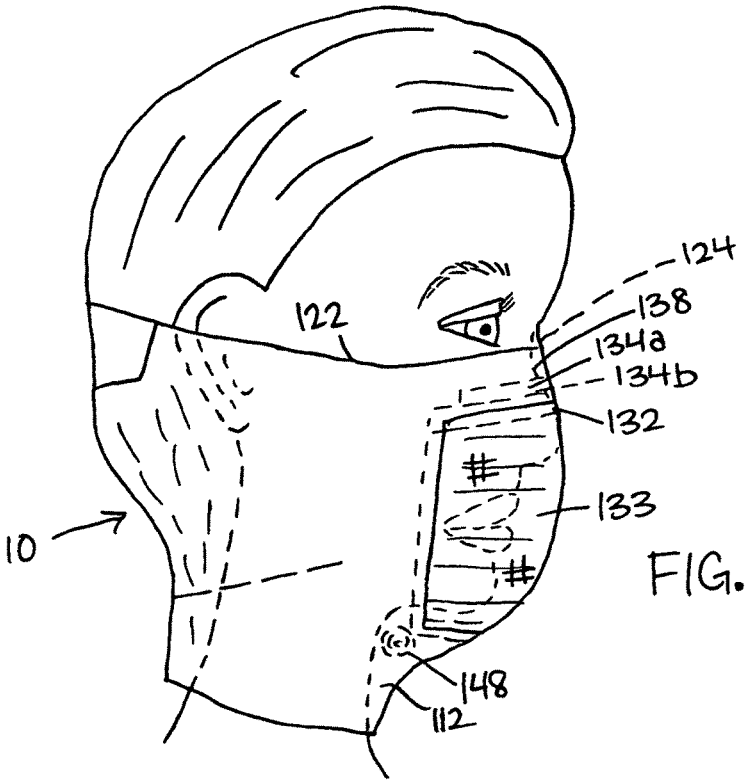
FIG. 8: illustrates a right side view of present disclosure in a first position on a wearer's lower face showing filter element in a plenum position (in phantom) in accordance with one non-limiting embodiment.
Figure 9:
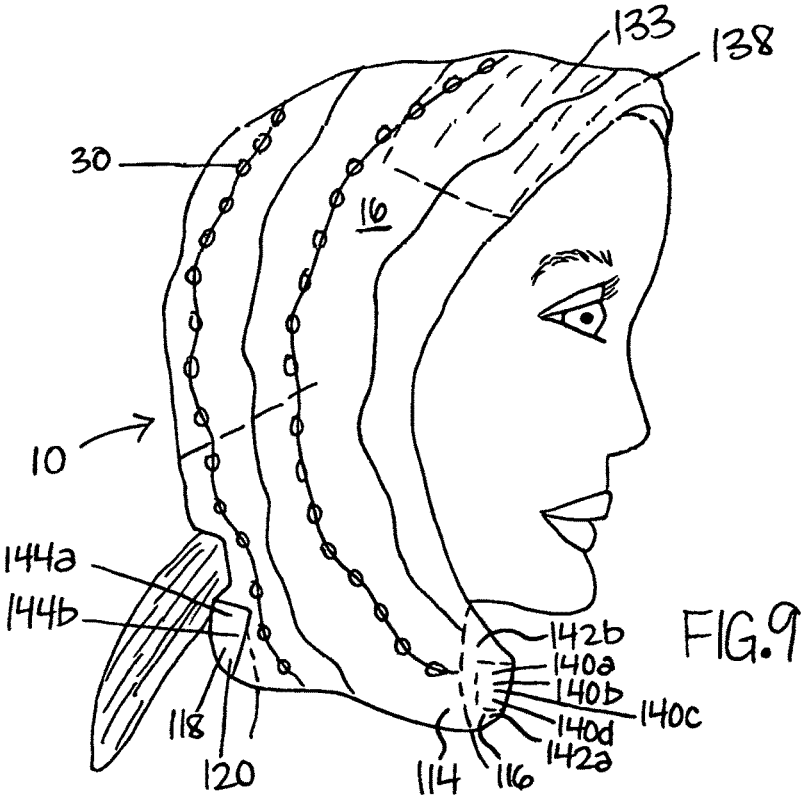
FIG. 9: illustrates a second alternative position of present disclosure as a head covering on a wearer in accordance with one non-limiting embodiment.
Figure 10:
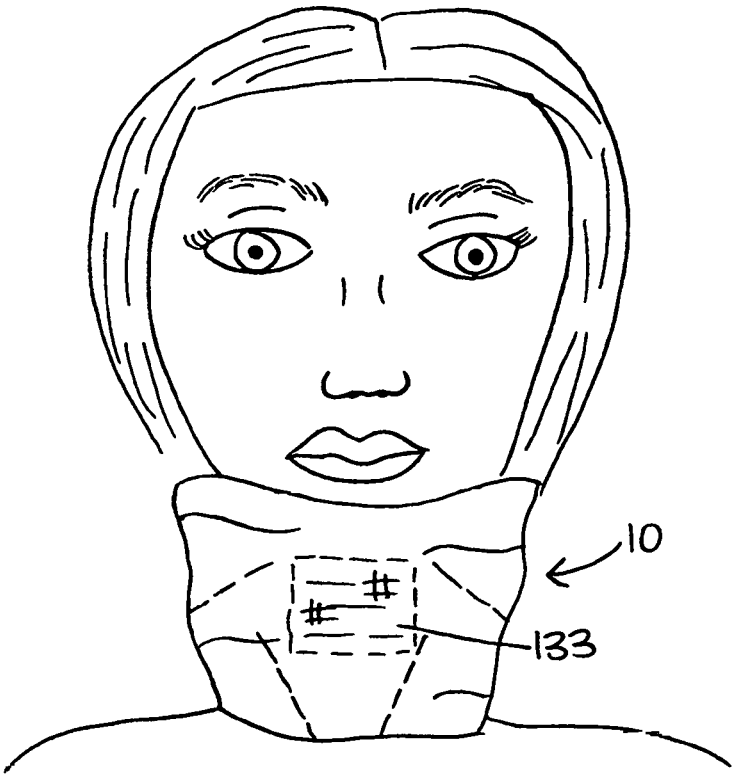
FIG. 10: illustrates a third alternative position of present disclosure as a neck warmer on a wearer in accordance with one non-limiting embodiment.

The disclosure claimed is:

1. A mask garment for a wearer, comprising:

an outer layer having an outer obverse side and an outer reverse side, the outer layer having a base and peripheral edges;

an inner layer having an inner obverse side and an inner reverse side, the inner layer having a base and peripheral edges, wherein a portion of the base of the inner layer is removed to form a first central opening of at least two central openings, cut in predetermined dimensions configured to be at an approximate point where the wearer's nose and mouth reside to provide air space and unobstructed breathing for the wearer;

an inter between layer having an obverse side and an inter between reverse side, the inter between layer having a base and peripheral edges;

wherein a portion of the outer reverse side is proximate to a portion of the inter between obverse side and a portion of the inner reverse side is proximate to a portion of the inter between reverse side;

wherein the peripheral edges of the inner layer, the outer layer, and the inter between layer are attached and form a unitary base region, the unitary base region configured to be placed over a lower-face to enclose the nose and mouth of the wearer;

a right upper strap having a free end configured to extend around at least a portion of the right side of the wearer's head, the right upper strap comprising a right tab extension;

a left upper strap having a free end configured to extend around at least a portion of the left side of the wearer's head, the left upper strap comprising a left tab extension;

a right lower connector having a free end configured to extend around at least a portion of the right side of the wearer's neck;

a left lower connector having a free end configured to extend around at least a portion of the left side of the wearer's neck;

a first fastening point of at least three fastening points, the first fastening point comprising a first fastening mechanism associated with the right tab extension and a second fastening mechanism associated with the right upper strap, wherein the first and second fastening mechanisms are configured to be releasably attached at the back of the wearer's head;

a second fastening point of the at least three fastening points, the second fastening point comprising a third fastening mechanism and a fourth fastening mechanism, the third fastening mechanism associated with the left tab extension and the fourth fastening mechanism associated with the left upper strap, wherein the third and fourth fastening mechanisms are configured to be releasably attached at the back of the wearer's head;

a third fastening point of the at least three fastening points, the third fastening point comprising a fifth fastening mechanism associated with the right lower connector and a sixth fastening mechanism associated with the left lower connector, wherein the fifth and sixth fastening mechanisms are configured to be releasably attached at the back of the wearer's neck;

wherein securement of the fastening mechanisms attached thereon at the first and second fastening points of the at least three fastening points is configured for causing a portion of the left upper edge of the left upper strap to be releasably attached between the first and second fastening mechanisms, and a portion of the right upper edge of the right upper strap to be releasably attached between the third and fourth fastening mechanisms, for securing the mask garment at the wearer's lower face and at the back of the wearer's head;

wherein securement of the fastening mechanisms attached thereon at the third fastening point of the at least three fastening points is configured for causing the right lower connector and the left lower connector to be joined together and releasably attached with the fifth and sixth fastening mechanisms at the back of the wearer's neck;

a filter element; and a retainer for holding the filter element in correspondence with the nose and mouth of the wearer;

wherein the mask garment may alternatively be positioned into one of at least three alternative positions, from a first position as a face mask, to a second alternative position as a head covering, or into a third alternative position as a neck warmer.

2. The mask garment according to claim 1, wherein the outer layer is a lightweight air permeable fabric material so as to provide unobstructed breathability to the wearer.

3. The mask garment of claim 2, wherein the outer layer conceals at least one feature of the inner layer and the inter between layer.

4. The mask garment of claim 1, wherein the inner layer is a soft flannel or fleece fabric material.

5. The mask garment of claim 1, wherein the inter between layer is a non-woven fabric material non-engagable to hook strip fasteners.

6. The mask garment of claim 1, further comprising a visual signal including indicia, or one or more structural, graphical or textural elements.

7. The mask garment of claim 1, wherein the first, second, third, and fourth fastening mechanisms comprising the first and second fastening points of the at least three fastening points, are magnetic disk components for releasable attachment at the back of the wearer's head.

8. The mask garment of claim 1, wherein the fifth and sixth fastening mechanisms comprising the third fastening point of the at least three fastening points, are selected from the group consisting of snaps and snap adjusters, hook and loop fasteners, buttons and button holes, tab and slot fasteners, hermaphroditic fasteners, and hinged clips for releasable attachment at the back of the wearer's neck.

9. The mask garment of claim 1, further comprising a right vapor roll and a left vapor roll located center of the right and left upper edges of the garment so as to reduce the possibility of air leakage at the wearer's nose bridge area and to reduce fogging of the wearer's eyeglasses.

10. A mask garment according to claim 1, wherein the retainer for retaining the filter element is hook strip fasteners framing the first central opening of the at least two central openings, for holding the filter element in a spread position over the nose and mouth of the wearer.

11. A mask garment according to claim 1, wherein the filter element includes a plurality of layers of filter materials configured to be placed over the nose and mouth of the wearer for protection from airborne particulates.

12. The mask garment of claim 1, wherein a second central opening of the at least two central openings is cut in predetermined dimensions from a portion of the base of the inter between layer configured to be at an approximate point where the wearer's nose and mouth reside, to allow air space and provide for unobstructed breathing for the wearer.

* * * * *